US008264481B2

(12) United States Patent
Kohno et al.

(10) Patent No.: US 8,264,481 B2
(45) Date of Patent: Sep. 11, 2012

(54) DISPLAY DEVICE

(75) Inventors: Tohru Kohno, Kokubunji (JP); Mitsuhide Miyamoto, Kawasaki (JP); Hajime Akimoto, Kokubunji (JP); Naruhiko Kasai, Yokohama (JP); Masato Ishii, Tokyo (JP)

(73) Assignees: Hitachi Displays, Ltd., Chiba-ken (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 1098 days.

(21) Appl. No.: 12/216,670

(22) Filed: Jul. 9, 2008

(65) Prior Publication Data

US 2009/0027374 A1 Jan. 29, 2009

(30) Foreign Application Priority Data

Jul. 23, 2007 (JP) ..... 2007-191296

(51) Int. Cl.
*G09G 5/10* (2006.01)

(52) U.S. Cl. ..... 345/212; 345/76; 345/77

(58) Field of Classification Search ..... 345/76, 345/77, 82, 83, 204, 211, 212, 214
See application file for complete search history.

(56) References Cited

U.S. PATENT DOCUMENTS

| | | | | |
|---|---|---|---|---|
| 2003/0030631 | A1* | 2/2003 | Chen et al. | 345/211 |
| 2005/0017933 | A1* | 1/2005 | Koyama | 345/76 |
| 2006/0017664 | A1* | 1/2006 | Takagi et al. | 345/76 |
| 2010/0001930 | A1 | 1/2010 | Koyama | |

FOREIGN PATENT DOCUMENTS

| | | |
|---|---|---|
| JP | 2002-123219 A | 4/2002 |
| JP | 2006-48011 | 6/2005 |

* cited by examiner

*Primary Examiner* — Alexander Eisen
*Assistant Examiner* — Mark Regn
(74) *Attorney, Agent, or Firm* — Stites & Harbison, PLLC; Juan Carlos A. Marquez, Esq

(57) ABSTRACT

To implement brightness change of pixels due to variations in environmental temperatures with low electric power, the display device includes a display part having a display area arrayed with plural pixels, a display scanning circuit and a signal driving circuit for driving the plural pixels, and a power circuit that supplies a current for illuminating each of the plural pixels with brightness corresponding to a display signal from the signal driving circuit; and a detection unit that includes: a monitor element for driving a constant current that detects environmental temperatures; and plural constant current sources, detects a voltage value relating to the luminous intensity of the pixels by the monitor element to generate a signal to control an output voltage of the power circuit, and changes over a constant current source of the monitor element according to a voltage value detected in the detection unit.

7 Claims, 19 Drawing Sheets

CURRENT DENSITY VS VOLTAGE

CURRENT DENSITY VS VOLTAGE

CURRENT DENSITY VS VOLTAGE

CURRENT DENSITY VS VOLTAGE

DISPLAY DEVICE

CLAIM OF PRIORITY

The present application claims priority from Japanese patent application JP 2007-191296 filed on Jul. 23, 2007, the content of which is hereby incorporated by reference into this application.

FIELD OF THE INVENTION

The present invention relates to a display device, and more particularly to a display device that curbs a driving voltage range for light emitting elements corresponding to a change in ambient temperatures to achieve lower power consumption.

BACKGROUND OF THE INVENTION

A spontaneous light emitting display device that configures pixels with light emitting elements such as organic EL elements (OLED: Organic Light Emitting Diode, also referred to as OLED elements) is in a practical stage. An image display device using spontaneous light emitting display elements is characterized by high visibility, not requiring an auxiliary lighting device such as the backlight of a liquid crystal display device, and quick response speed. An organic EL display panel that uses organic EL elements being a paradigm of spontaneous light emitting display elements for current driving changes in light emission luminance, depending on environmental temperatures. The light emission luminance of individual organic EL elements changes also due to secular changes, causing variations in surface brightness of a display area.

FIG. 16 is a circuit diagram showing a first construction example of an organic EL display panel that constitutes a display device equipped with a traditional temperature correction system. FIG. 17 is an explanatory drawing of detection operation points of the transitional organic EL display panel shown in FIG. 16. In FIG. 17, the horizontal axis indicates anode voltages (V) of organic EL element, and the vertical axis indicates a current density (mA/cm$^2$) flowing through an organic EL element. In FIG. 16, the display device includes a display part and a detection unit. In a display area 15 of the display part 100, plural pixels 10 are matrix-arrayed. Each pixel 10 is formed at an intersection of a signal line 11 and a select switch line (scanning line) 12. Moreover, each pixel 10 is provided with an illumination switch line 13 provided in common for pixels connected to the select switch 12, and a power line 14 connected in common for pixels connected to a common signal line 11.

The signal line 11 is connected to a signal line driving circuit 16, and supplies a display signal to a pixel selected by the select switch line 12 and the illumination switch line 13 connected to a display scanning circuit 17. The power line 14 supplies an illumination current to the selected pixel 10 from the power circuit 18 and illuminates the pixel with brightness corresponding to the display signal. A display signal and a timing signal 29 are inputted to the signal line driving circuit 16 and the display scanning circuit 17 from a signal source (not shown) such as a host computer.

The power circuit 18 is provided with a detection unit 200 that includes a detection unit 200 that includes current source 41, a monitor element 20 to detect environmental temperatures, a buffer amplifier 21, an analog/digital converter 22 (AD converter: ADC), and a power control unit 28. The power control unit 28 controls the power circuit 18, according to the output of the ADC 22, based on an environmental temperature detected by the monitor element 20. Here, an organic EL element is used for the monitor element 20.

In the organic EL display panel constructed shown in FIG. 16, a current I1 is fed to the monitor element 20 from the current source 41. At this time, as shown in FIG. 17, the voltage of the anode of the organic EL device being the monitor element 20 is set to a voltage V1 as a high temperature region when an environmental temperature is a defined temperature abnormality, and set to a voltage V1' in the case of low temperatures lower than it. The voltages V1 and V1' are inputted to the AD converter 22 through the buffer amplifier 21 for conversion into a digital value. The power control unit 28, when the digital value is small, determines that the system is in the high temperature region, and lowers a power supply voltage of the power circuit. When the digital value is large, it determines that the system is in a low temperature region, and raises a power supply voltage. By using, as the monitor element 20, the same element as that of the pixel 10 provided in the display area, brightness deterioration and variations due to secular changes can be corrected.

FIG. 18 is a circuit diagram showing a second construction example of an organic EL display panel that constitutes a display device equipped with a traditional temperature correction system. FIG. 19 is an explanatory drawing of detection operation of the transitional organic EL display panel shown in FIG. 18. In FIG. 18, only portions different from FIG. 16 are described, and descriptions of common portions are omitted because they overlap. Detection control lines 33 are disposed in parallel with the select switch lines 12 and the illumination switch lines 13. The detection control lines 33 detect current values of pixels connected in common to the select switch lines 12, and output them to the detection scanning circuit 32.

For the detection scanning circuit 32 to detect the respective current values of organic EL elements constituting individual pixels to detect variations in brightness within the display area, and correct them, a detection unit that includes current source 31, buffer amplifier 21, AD converter 22, and signal correction control unit 34 is provided. Changeover switches 43 that include switches SWA (1 to n) turning on and off between the signal driving circuit 16 and the signal lines 11, and switches SWB (1 to n) turning on and off between the signal lines 11 and the current source 31 are provided. The changeover switches 43 operate so that when one switch is on, the other is off, and vice versa.

In a normal display mode, switches SWA (1 to n) of the changeover switches 43 are on, and switches SWB (1 to n) are off. In this state, a signal is supplied from the signal driving circuit 16 to a pixel connected to a select switch line 12 selected by the display scanning circuit 17 through the signal line 11, and the pixel illuminates with brightness corresponding to the value of the display signal by an illumination signal of the illumination switch lines 13 to display a required two-dimensional image.

On the other hand, in a detection mode, switches SWB (1 to n) of the changeover switches 43 are on, and switches SWA (1 to n) are off. Changeover to the detection mode may be made when main power to the image display device is turned on or off, during flyback period, or by a manual operation.

In the detection mode, a current I3 is fed from the current source 31 to organic EL elements of pixels through the signal lines 11 of the pixel side to monitor properties. At this time, a voltage of the anode of the organic EL elements is V3 before deterioration and V3' after deterioration, as shown in FIG. 19. The voltages V3 and V3' are inputted to the AD converter (ADC) 22 through the buffer amplifier for change to digital values. When the digital values are below a specific value, the system determines that the organic EL elements do not deteriorate, and does not perform special brightness adjustment. However, when the digital values are greater than the specific value, the system determines that the organic EL elements deteriorate, and the signal correction control unit 34 affords a control signal to the signal driving circuit 16 to correct the display signal.

For individual pixels, their current values are individually detected by scanning of the detection scanning circuit 32 and the signal timing of the signal driving circuit 16, and determined in the signal correction control unit 34. Thereby, even when the organic EL elements deteriorate due to secular changes, high-quality image display free of variations is achieved while maintaining a given brightness.

This system configuration achieves stable brightness control regardless of large variations in environmental temperatures. Such a related art is disclosed in JP-A-2006-048011.

SUMMARY OF THE INVENTION

Organic EL elements depend on current values for their luminous intensity. In the conventional temperature correction control system as described above, the buffer amplifiers and the AD converter require large power consumption. That is, since the temperature coefficient of the organic EL elements is as large as several tens mV/degree, voltages for securing currents for obtaining brightness corresponding to temperature changes change greatly, a voltage difference V1' and V1 as shown in FIG. 17 is large. When the voltage difference is large, since a voltage range necessary for the buffer amplifier and the AD converter of FIG. 16 become large, the display device does not operate with a low power supply voltage, and electric power consumed in the buffer amplifier and the AD converter becomes large.

In JP-A 2006-48011, a monitor element for driving a constant current is provided, a voltage applied to the monitor element is detected, and the voltage is applied to a light emitting element, whereby brightness variations due to changes in environmental temperatures and secular changes are curbed. However, since the organic EL element change greatly in its properties, depending on environmental temperatures and secular changes, the range of detected voltages are wide. Therefore, since the range of voltages necessary for the buffer amplifier and the like to buffer a detected voltage becomes wide, high power supply voltages are required to constitute circuits such as the buffer amplifier, resulting in large power consumption.

A buffer amplifier and an AD converter provided for transitional secular change correction systems have large power consumption. When the deterioration of organic EL elements halves brightness, since the systems operate at voltage V3' as shown in FIG. 19, a voltage difference is large with respect to voltage V3 before the deterioration of the organic EL elements. When a system is built with the deterioration of organic EL elements in mind, since a voltage range necessary for the buffer amplifier and the AD converter in FIG. 18 becomes large, the system does not operate at a low power supply voltage, and electric power consumed in the buffer amplifier and the AD converter becomes large.

A first object of the present invention is to provide a display device that realizes brightness change of pixels due to variations in environmental temperatures with low electric power. A second object of the present invention is to provide a display device that realizes brightness variations among pixels due to deterioration as a result of secular changes with low electric power.

To achieve the first object, a display device of the present invention includes: a display part including a display area arrayed with plural pixels, a display scanning circuit and a signal driving circuit for driving the plural pixels, and a power circuit that supplies a current for illuminating each of the plural pixels with brightness corresponding to a display signal from the signal driving circuit; and a detection unit that includes: a monitor element for driving a constant current that detects environmental temperatures; and plural constant current sources, detects a voltage value relating to the luminous intensity of the pixels by the monitor element to generate a signal to control an output voltage of the power circuit, and changes over a constant current source of the monitor element according to a voltage value detected in the detection unit.

To achieve the second object, a display device of the present invention includes: a display part including a display area arrayed with plural pixels, a display scanning circuit and a signal driving circuit for driving the plural pixels, a power circuit that supplies a current for illuminating each of the plural pixels with brightness corresponding to a display signal from the signal driving circuit, a detection control line to detect current values of the pixels, a detection scanning circuit that applies a scanning signal to the detection control line, and a display part changeover means that alternatively selects the signal driving circuit and the detection unit changeover means for the signal line; and a detection unit that includes a current source to output plural constant current values, a detection unit changeover means to select one of the current sources, and a signal correction control unit that is connected to the signal driving circuit and corrects a display signal supplied to the signal line.

By the construction for achieving the first object, by changing over a constant current value of the monitor element according to a voltage value detected in the detection unit, a variation range of voltages for feeding a current value corresponding to an environmental temperature to the monitor element can be reduced.

By the construction for achieving the second object, by correcting a display signal supplied to the pixels according to a voltage value detected in the detection unit, variations in luminous intensity due to secular changes can be reduced.

Display elements used for pixels and monitor elements are not limited to organic EL elements, and the present invention can also apply to a display device using spontaneous light emitting display elements that is reduced in luminous intensity due to variations in environmental temperatures and deterioration due to secular changes.

DETAILED DESCRIPTION OF THE PREFERRED EMBODIMENTS

Preferred embodiments of the present invention will be described in detail below.

First Embodiment

Figure 1:
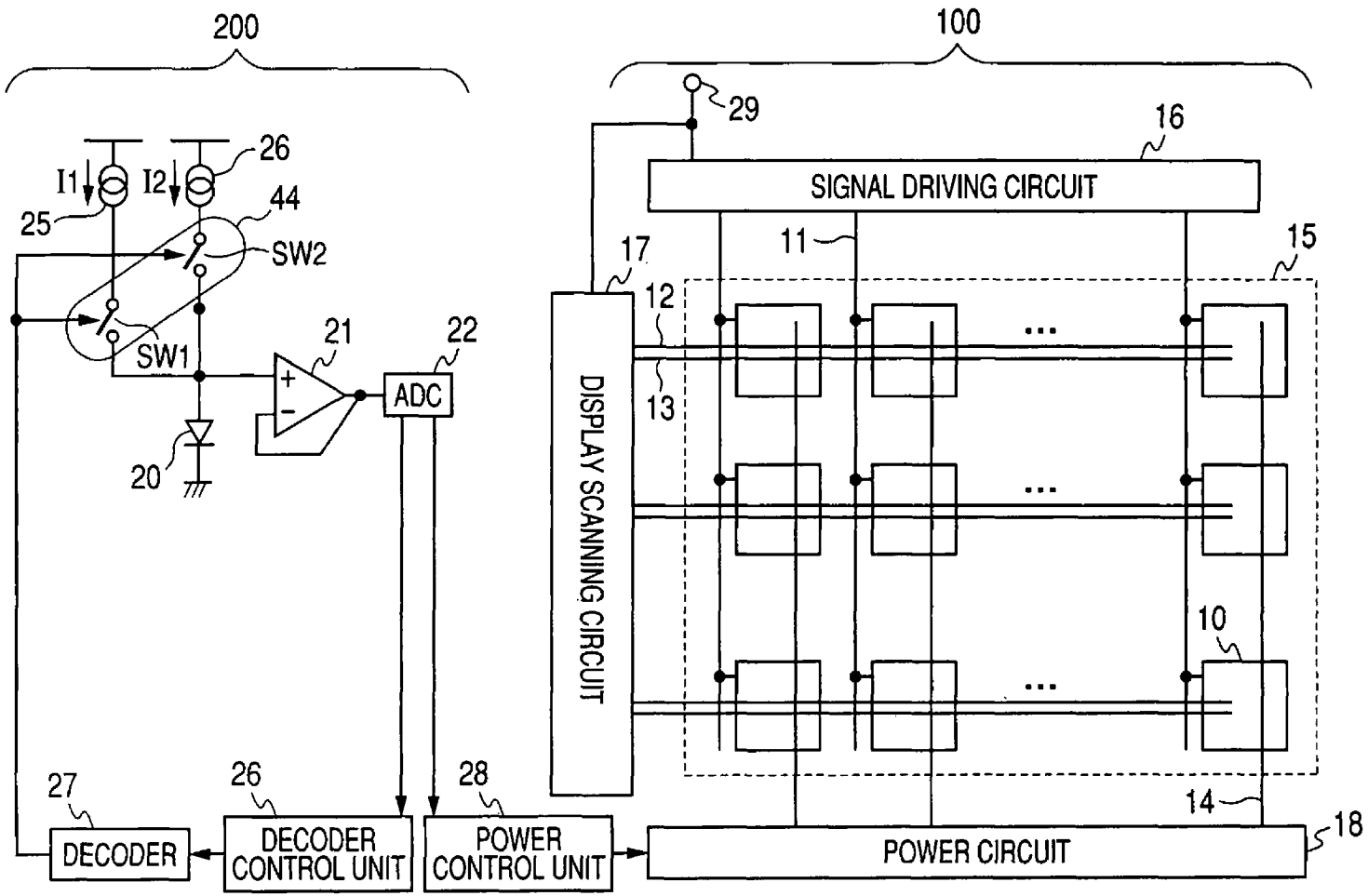
FIG. 1 is a block diagram of an organic EL display panel equipped with a temperature correction system to describe a first embodiment of a display device of the present invention.
Figure 2:
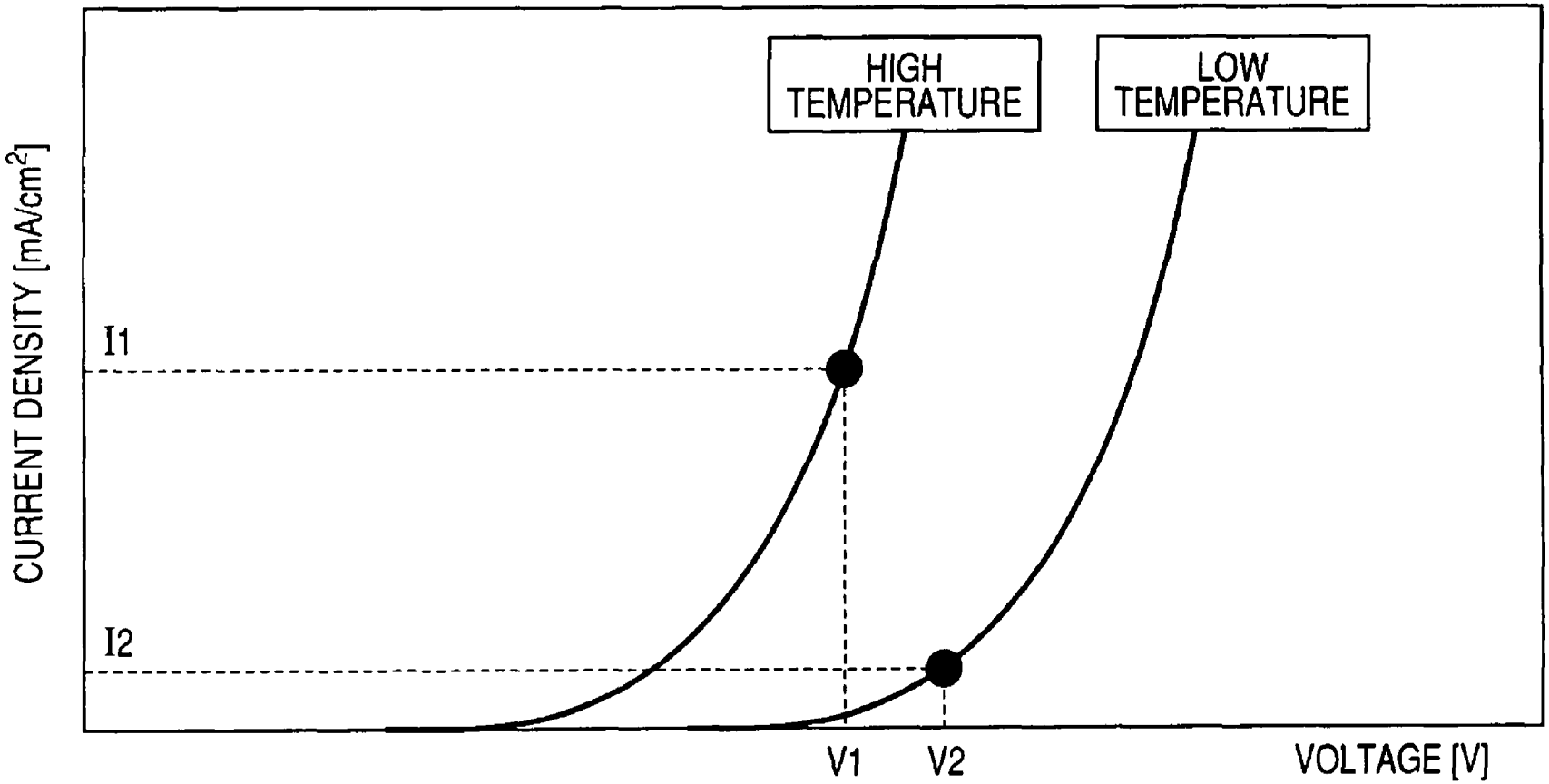
FIG. 2 is an explanatory drawing of detection operation of the organic EL display panel shown in FIG. 1.

FIG. 1 is a block diagram of an organic EL display panel equipped with a temperature correction system to describe a first embodiment of a display device of the present invention. FIG. 2 is an explanatory drawing of detection operation of the organic EL display panel shown in FIG. 1. FIG. 2 is an explanatory drawing of detection operation of the organic EL display panel shown in FIG. 1. In FIG. 1, plural pixels 10 are matrix-arrayed in a display area 15 of a display part 100 of the organic EL display panel. Each pixel 10 is formed in an intersection of a signal line 11 and a select switch (scanning line) 12. Each pixel 10 is also provided with a luminance switch line 13 provided in common for pixels connected to the select switch line 12, and a power line 14 connected in common to pixels connected to the common signal lines 11.

The signal lines 11, which are connected to a signal line driving circuit 16, supply a display signal to a pixel selected by the select switch lines 12 connected to the display scanning circuit 17 and the luminance switch lines. The power lines 14 supply a luminance current to the selected pixel 10 from a power circuit 18 and light the pixel 10 with brightness corresponding to the display signal. A display signal and a timing signal 29 (not shown in the drawing) are inputted to the signal line driving circuit 16 and the display scanning circuit 17 from a signal source (not shown in the drawing) such as a host computer.

The power circuit 18 is provided with a signal from a detection unit 200 that includes a first current source 25, a second current source 26, changeover switch 44, a monitor element 20 to detect environment temperatures, a buffer amplifier 21, an analog/digital converter (AD converter: ADC) 22, a power control unit 28, a decoder control unit 26, and a decoder 27. According to the output of the AD converter 22 based on an environmental temperature detected by the monitor element 20, the power control unit 28 controls the power circuit 18, and the output of the AD converter 22 is supplied to the decoder 27 from the decoder control unit 26 to switch the changeover switch 44. Organic EL elements are used for the monitor element 20.

The changeover switch 44 includes a first switch (hereinafter referred to as a high temperature side switch) SW1 and a second switch (hereinafter referred to as a low temperature side switch) SW2. The changeover switch 44 enables the first current source 25 and the second current source 26 to be switched on and off, or switched off and on.

The changeover switch 44 is on in the high temperature side switch SW1, and off in the low temperature side switch SW2. In this state, a current I1 flows through the organic EL element 20 being a monitor element from the first current source 25. At this time, a voltage of the anode of the organic EL device 20 is V1 as shown in FIG. 2. The voltage V1 rises as temperatures become lower, and digital values converted by the AD converter 22 also increase.

A threshold value is provided for the digital values, and when the decoder control unit 26 is equal to or greater than a digital value corresponding to a voltage V2, the decoder control unit turns off the high temperature side switch SW1 and turns on the low temperature side switch SW2. When the low temperature side switch SW2 has been switched on, the second current source 26 is supplied to the organic EL element 20. A detection voltage at this time is in a range from V1 to V2.

By the first embodiment, a variation range of voltages for feeding current values corresponding to variations in environmental temperatures to the monitor element can be reduced. Therefore, voltage ranges of V1 and V2 can be reduced, enabling the display device to operate with low power consumption.

Second Embodiment

Figure 3:
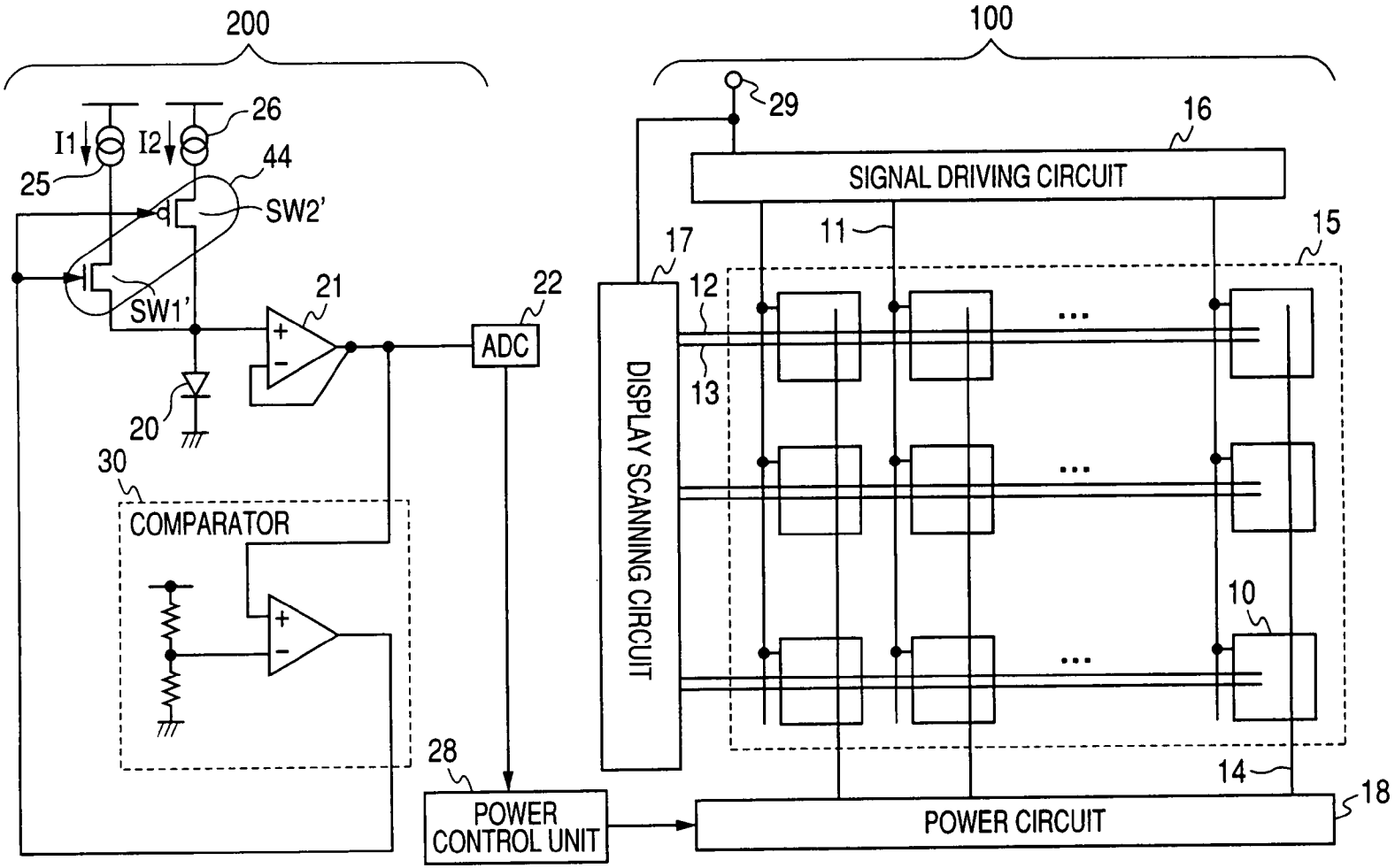
FIG. 3 is a block diagram of an organic EL display panel equipped with a temperature correction system to describe a second embodiment of a display device of the present invention.

FIG. 3 is a block diagram of an organic EL display panel equipped with a temperature correction system to describe a second embodiment of a display device of the present invention. In a second embodiment, a decoder is not used for switching control of current sources as it is in the first embodiment, but a comparator 30 is used. That is, an analog output of the buffer amplifier 21 is inputted directly to the comparator 30 for comparison with a specific value set in advance by a resistance dividing circuit or the like. A result of the comparison is used as a changeover signal of the changeover switch 44 of a detection side. Other constructions are the same as those in the first embodiment. The comparator 30 is an analog circuit. Use of such an analog circuit also enables changeover control of current sources.

Also by the second embodiment, a variation range of voltages for feeding current values corresponding to variations in environmental temperatures to the monitor element can be reduced. As a result, voltage ranges of V1 and V2 can be reduced, enabling the display device to operate with low power consumption.

Third Embodiment

Figure 4:
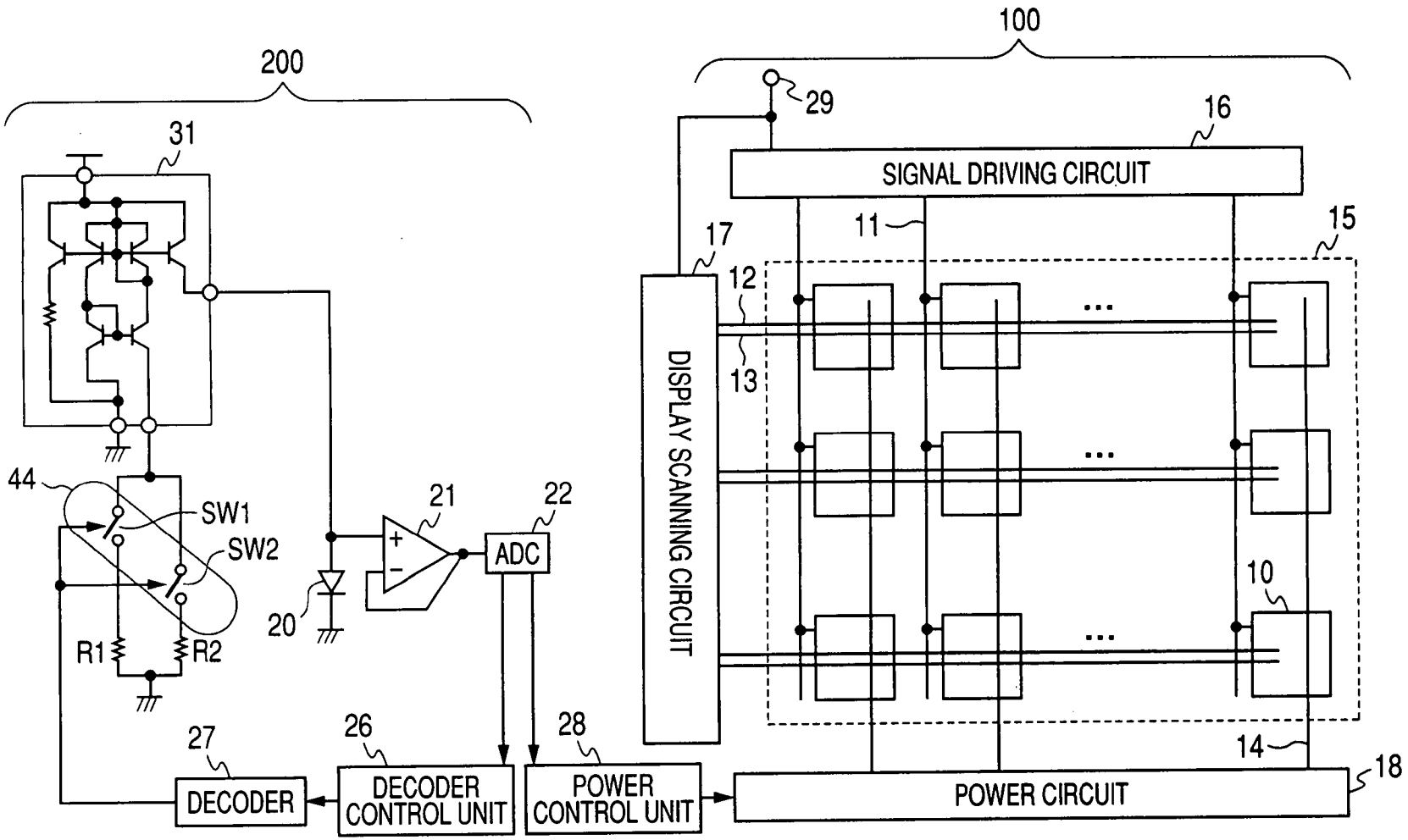
FIG. 4 is a block diagram of an organic EL display panel equipped with a temperature correction system to describe a third embodiment of a display device of the present invention.

FIG. 4 is a block diagram of an organic EL display panel equipped with a temperature correction system to describe a third embodiment of the display device of the present invention. The third embodiment is characterized in that a constant current source of band gap type is used as a current source of the detection unit 200 in the first embodiment. The constant current source 31 of band gap type includes a parallel circuit of a first external resistor R1 and a second external resistor R2 that have different resistance values, and a detection unit changeover switch 44 that selectively connects a first external resistor R1 and a second external resistor R2 to the constant current source 31. Other constructions are the same as those in the first embodiment.

Since current amounts supplied by the constant current source 31 of band gap type equipped with the external resistors are inversely proportional to resistance values of the external resistors, current amounts can be adjusted simply by changing over the external resistors. Therefore, one external current source has only to be provided, with the result that there are fewer external parts.

By the third embodiment, a variation range of voltages for feeding current values corresponding to variations in environmental temperatures to the monitor element can be reduced. As a result, voltage ranges of V1 and V2 can be reduced, enabling the display device to operate with low power consumption.

Fourth Embodiment

Figure 5:
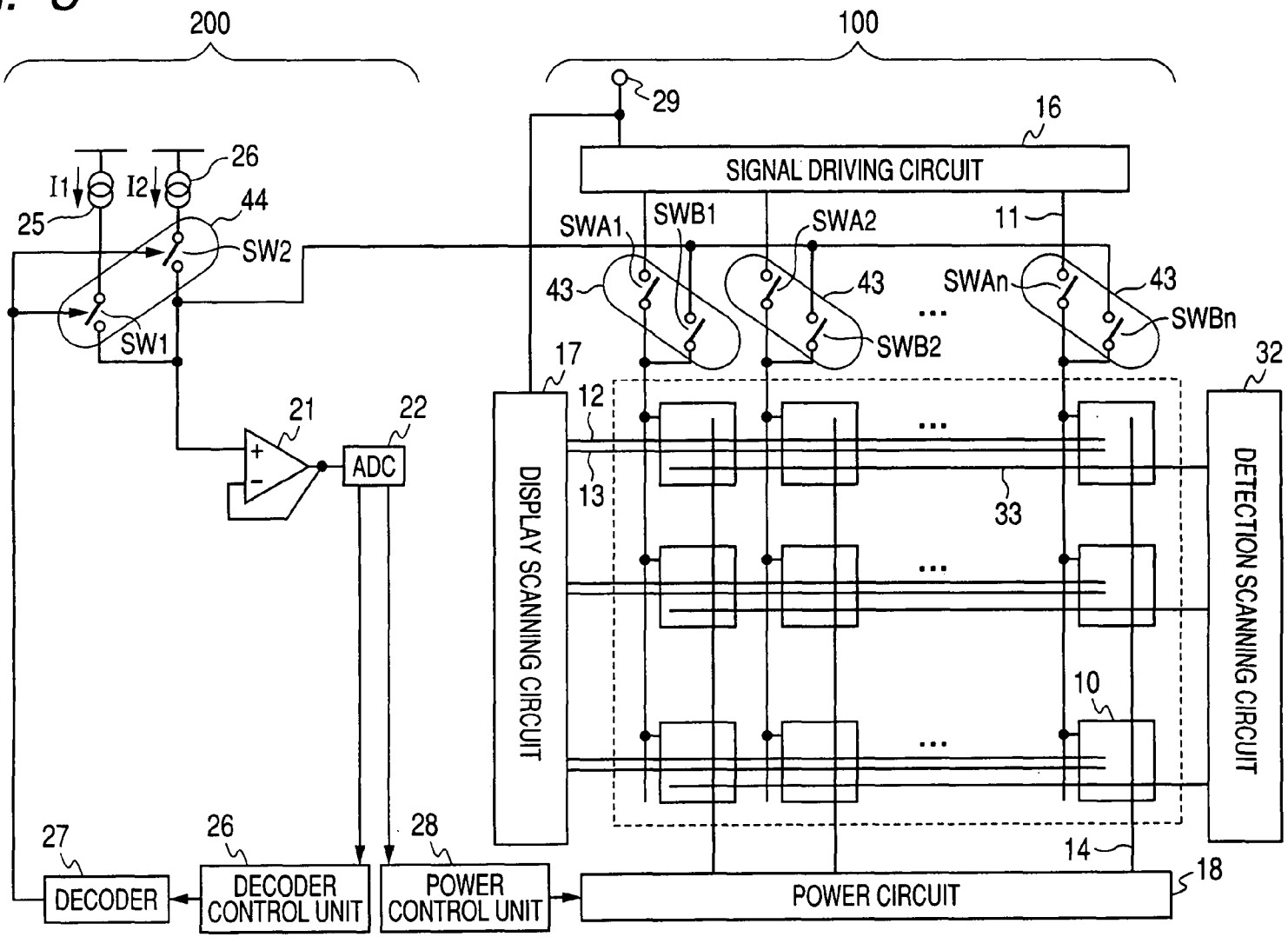
FIG. 5 is a block diagram of an organic EL display panel equipped with a temperature correction system to describe a fourth embodiment of a display device of the present invention.

FIG. 5 is a block diagram of an organic EL display panel equipped with a temperature correction system to describe a fourth embodiment of the display device of the present invention. In the first to fourth embodiments described previously, the same organic EL element as the display element to constitute the pixels of the display part is used for the monitor element of the detection part 200 to detect detects environmental temperatures. On the other hand, in the fourth embodiment, the organic EL element to constitute the pixels of the display part 100 is used as a detection element of environmental temperatures. Therefore, a display part changeover switch 43 is inserted between the signal lines 11 and the signal driving circuit of the display part 100, detection control lines 33 to detect a current value of the pixel 10 are provided in parallel with the select switch lines 12, and a detection scanning circuit 32 to apply a scanning signal to the detection control lines 33 is provided.

In FIG. 5, when a signal for displaying images is supplied to the pixel 10, SWA1, SWA2, . . . , SWAn of the display part changeover switch 43 are selectively turned on, and when an organic EL element of a pixel is monitored, any of SWB1, SWB2, . . . , SWBn is selected. The organic EL element to be monitored of a pixel of a specific signal line is selected vertically by the detection scanning circuit 32 and horizontally by turning on any of switches SWB1, SWB2, . . . , SWBn. The organic EL element to be selected is optional.

According to the fourth embodiment, without needing elements for monitor, a variation range of voltages for feeding current values corresponding to variations in environmental temperatures to the monitor element can be reduced. Therefore, voltage ranges of V1 and V2 described previously can be reduced, enabling the display device to operate with low power consumption.

Fifth Embodiment

Figure 6:
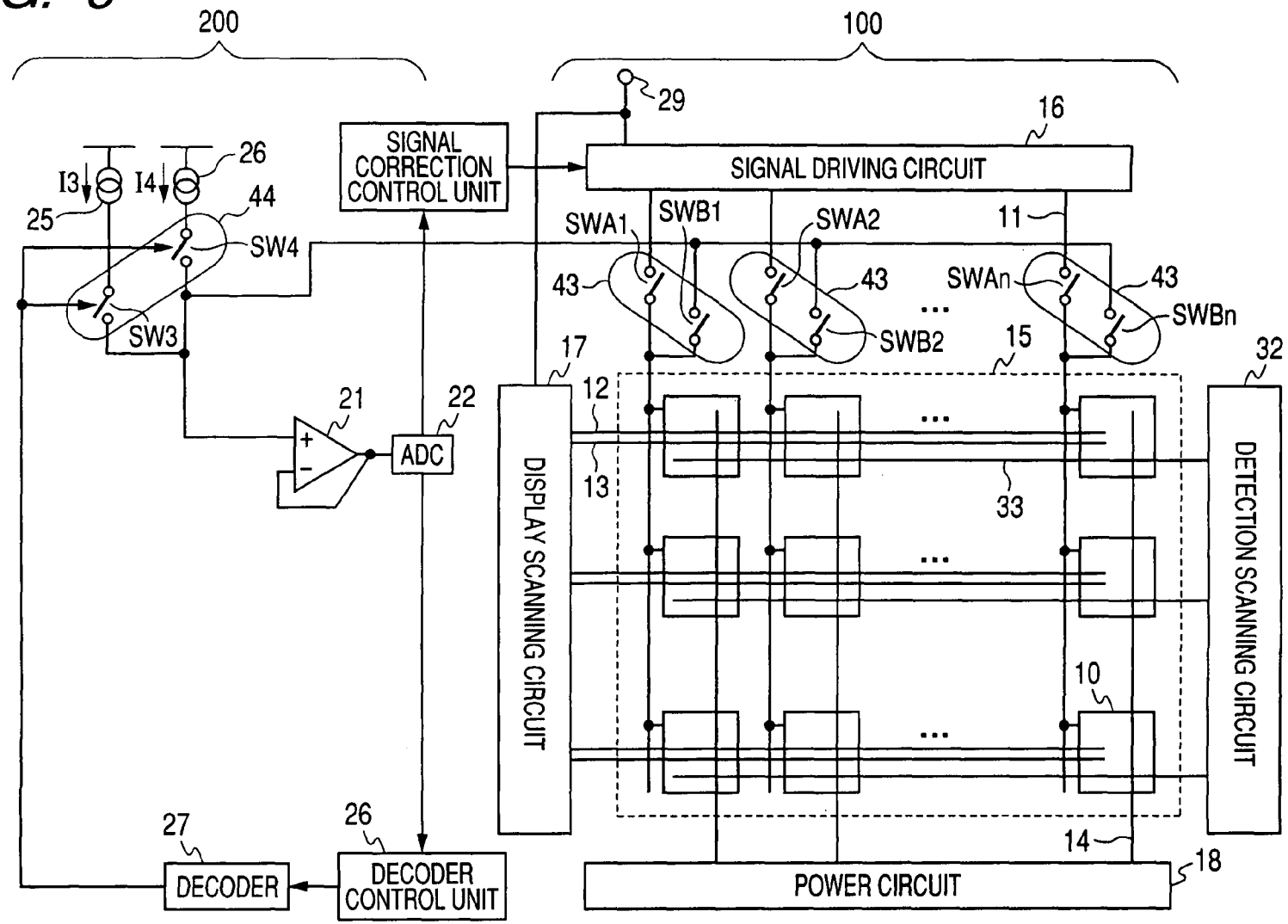
FIG. 6 is a block diagram of an organic EL display panel that corrects reduction in light emission luminance caused by deterioration due to secular change, to describe a fifth embodiment of a display device of the present invention.
Figure 7:
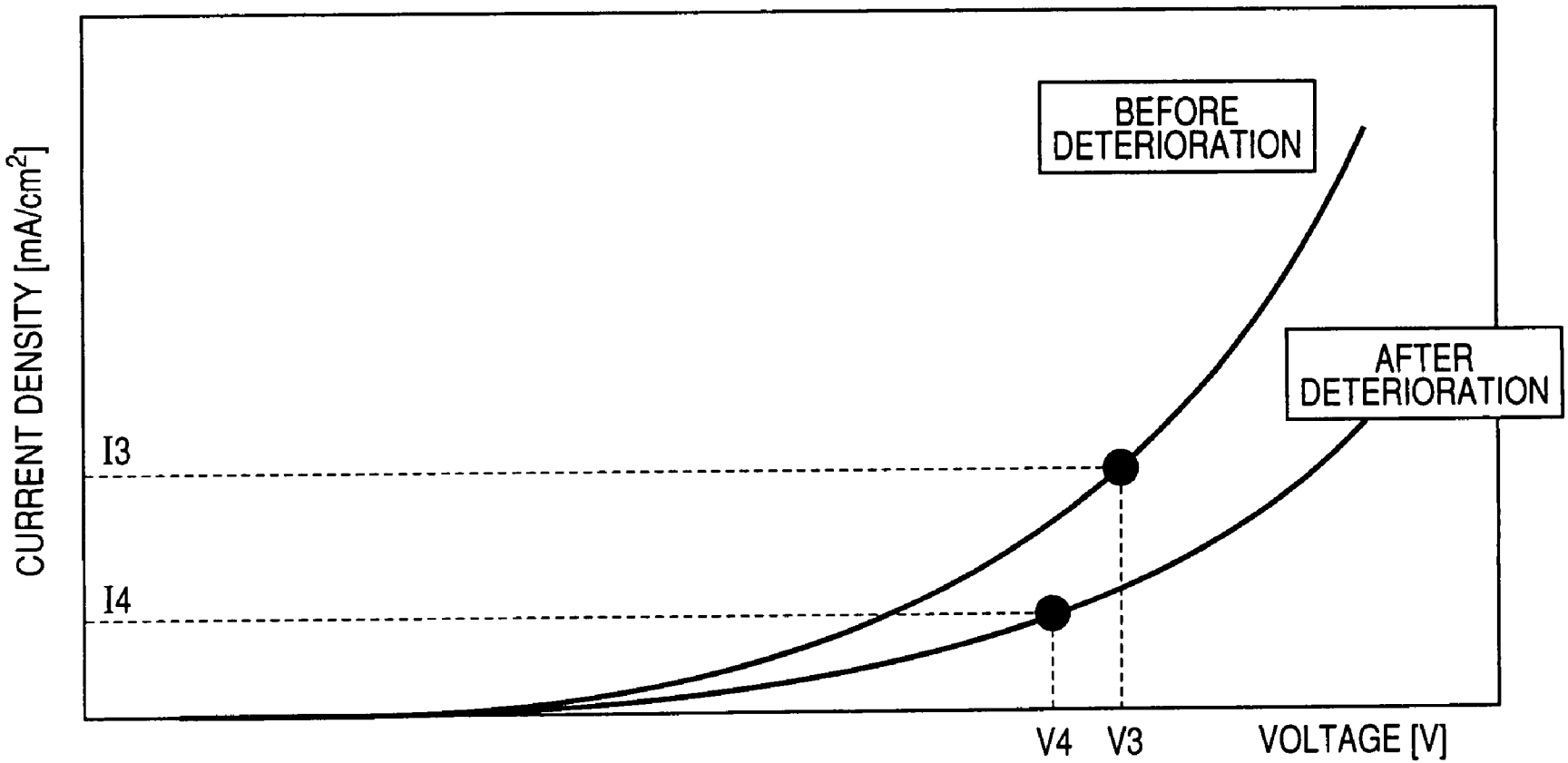
FIG. 7 is an explanatory drawing of detection operation of the organic EL display panel shown in FIG. 6.

FIG. 6 is a block diagram of an organic EL display panel that corrects reduction in light emission luminance caused by deterioration due to secular change, to describe a fifth embodiment of a display device of the present invention. FIG. 7 is an explanatory drawing of detection operation of the organic EL display panel shown in FIG. 6. In the fourth embodiment of FIG. 5, one output of the AD converter 22 is afforded to the power control unit 28 to change over a voltage of the power circuit 18. In contrast to this, in the fifth embodiment, a signal correction circuit 34 is provided that inputs one output of the AD converter 22 to correct a display signal supplied from the signal driving circuit 16 to the signal lines 11. The same power control unit 28 as that in FIG. 5 may be provided in FIG. 6.

In FIG. 6, as is conventionally done, the switch SW3 of the detection unit changeover switch 44 is selected, and the switches SWA3 to SWAn of the display part changeover switch 43 are selected, whereby a current I3 is fed from the first power source (high-voltage side power source) 25 to the organic EL element of the pixel 10. At this time, a voltage of the anode of the organic EL device is V3 as shown in FIG. 7. The voltage V3 rise as the element deteriorates, and digital values converted by the AD converter 22 also increase. Here, a threshold value is provided in advance for the digital values, and the decoder 27 is provided that, when a digital value corresponding to a voltage V4 or greater is reached, turns off the switch SW3 of the detection unit changeover switch 44, and turns on the switch SW4. A detection voltage at this time is in a range from V3 to V4. Voltage ranges of V3 and V4 are small.

According to the fifth embodiment, a variation range of voltages for feeding current values to correct variations in light emission luminance caused by deterioration due to secular change of organic EL elements can be reduced. Therefore, voltage ranges of the V3 and V4 described previously are small, enabling the display device to operate with low power consumption.

Sixth Embodiment

Figure 8:
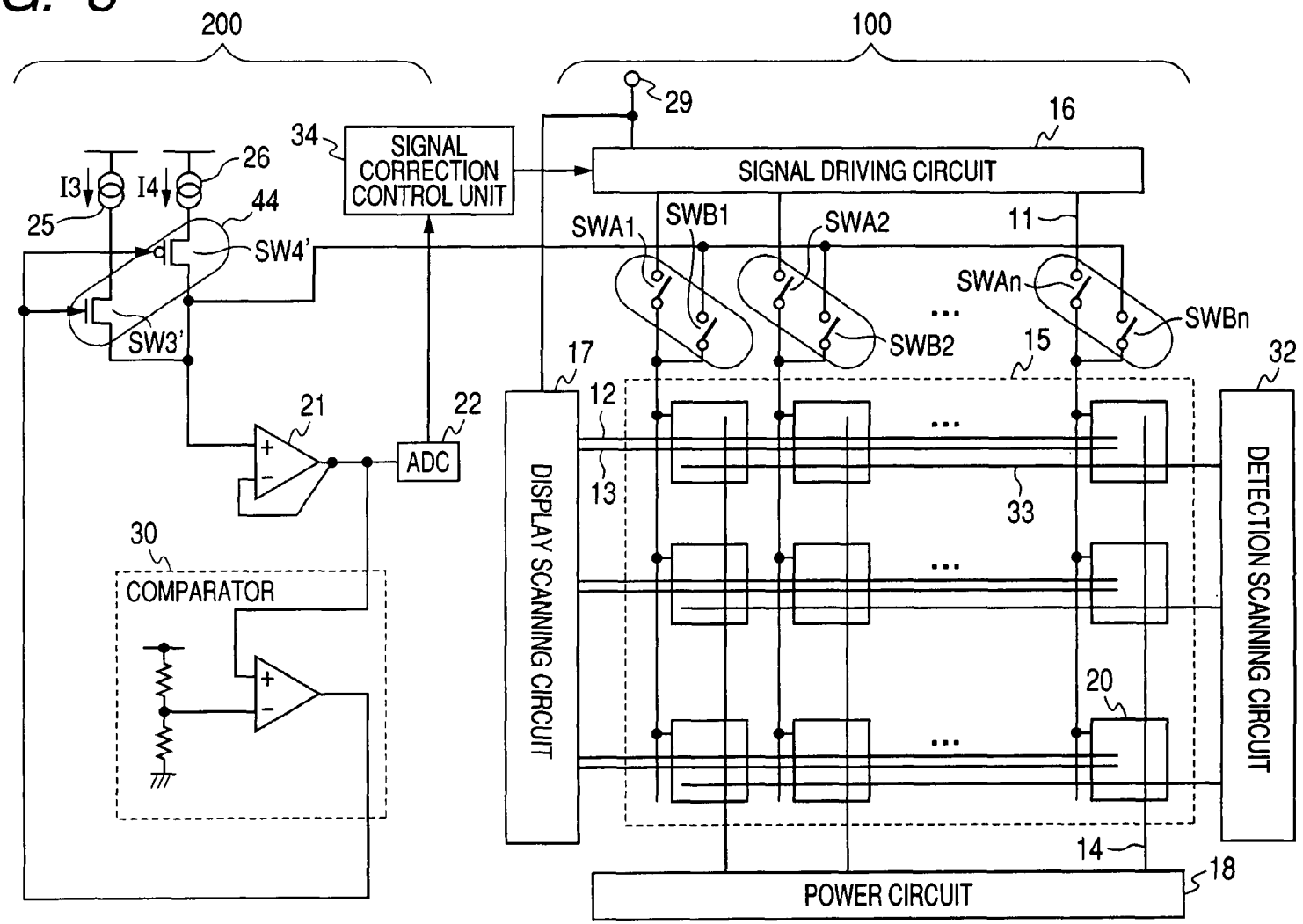
FIG. 8 is a block diagram of an organic EL display panel that corrects reduction in light emission luminance caused by deterioration due to secular change, to describe a sixth embodiment of a display device of the present invention.

FIG. 8 is a block diagram of an organic EL display panel that corrects reduction in light emission luminance caused by deterioration due to secular change, to describe a sixth embodiment of the display device of the present invention. In the sixth embodiment, the comparator 30 is provided in place of the decoder control unit 26 and the decoder 27 of the fifth embodiment described in FIG. 6. That is, analog output of the buffer amplifier 21 is inputted directly to the comparator 30 for comparison with a specific value set previously by a resistance dividing circuit or the like. A result of the comparison is used as a changeover signal of the detection side changeover switch 44. Other constructions are the same as those in the fifth embodiment. The comparator 30 is an analog circuit. Even use of such an analog circuit allow changeover control of current sources.

Also by the sixth embodiment, a variation range of voltages for feeding current values to correct variations in light emission luminance caused by deterioration due to secular change of organic EL elements can be reduced. Therefore, voltage ranges of the V3 and V4 described previously are small, enabling the display device to operate with low power consumption.

Seventh Embodiment

Figure 9:
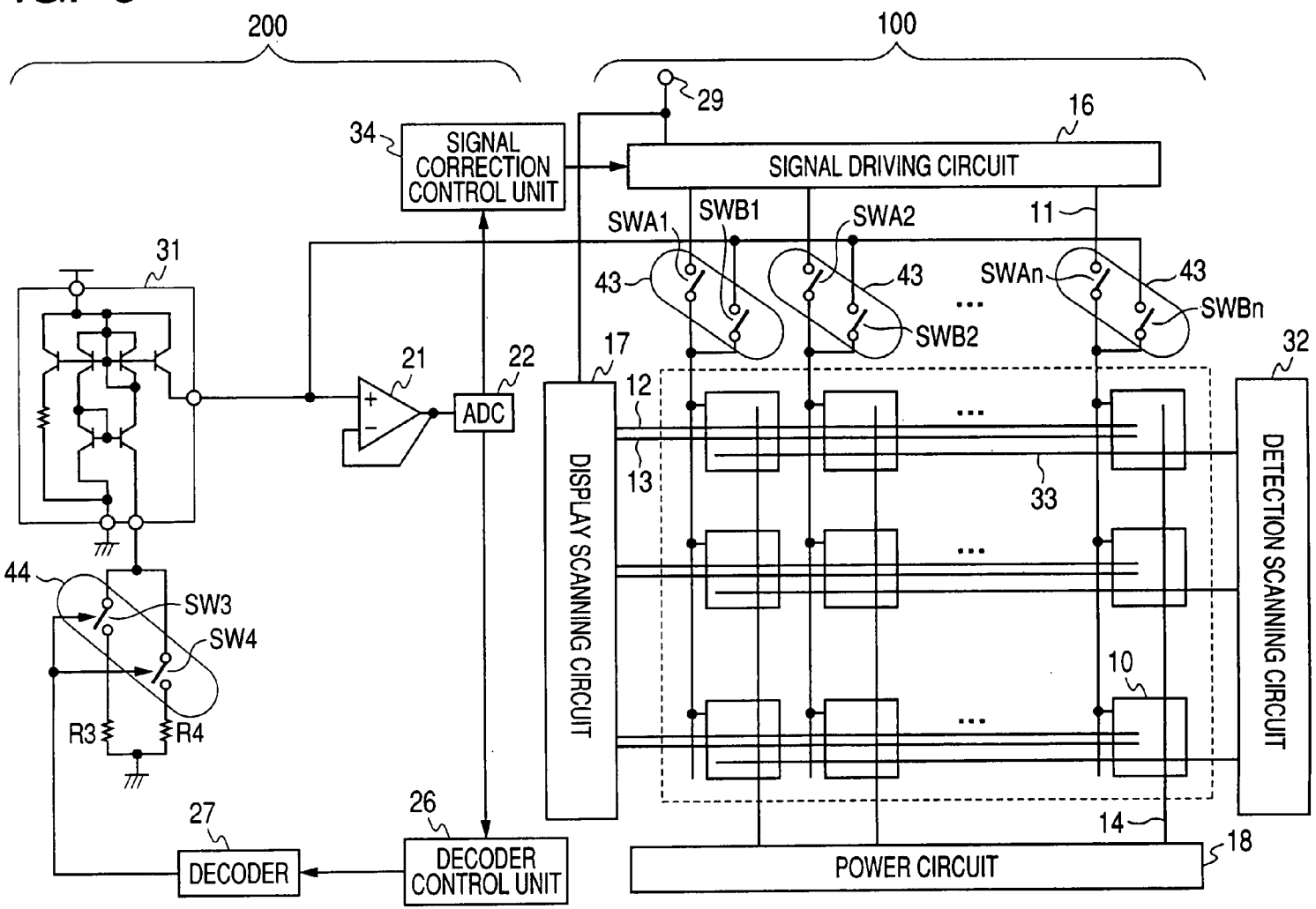
FIG. 9 is a block diagram of an organic EL display panel that corrects reduction in light emission luminance caused by deterioration due to secular change, to describe a seventh embodiment of a display device of the present invention.

FIG. 9 is a block diagram of an organic EL display panel that corrects reduction in light emission luminance caused by deterioration due to secular change, to describe a seventh embodiment of the display device of the present invention. The seventh embodiment is characterized in that the constant current source 31 of band gap type is used in place of the first and second current sources 25 and 26 in the sixth embodiment. The constant current source 31 of band gap type includes a parallel circuit of a first external resistor R1 and a second external resistor R2 that have different resistance values, and a detection unit changeover switch 44 consisting of switches SW1 and SW2 that selectively connects a first external resistor R1 and a second external resistor R2 to the constant current source 31. Other constructions are the same as those in the first embodiment.

Since current amounts supplied by the constant current source 31 of band gap type equipped with the external resistors are inversely proportional to resistance values of the external resistors, current amounts can be adjusted simply by changing over the external resistors. Therefore, one external current source has only to be provided, with the result that there are fewer external parts.

Also by the seventh embodiment, a variation range of voltages for feeding current values to correct variations in light emission luminance caused by deterioration due to secular change of organic EL elements can be reduced. Therefore, voltage ranges of the V3 and V4 described previously are small, enabling the display device to operate with low power consumption.

Figure 10:
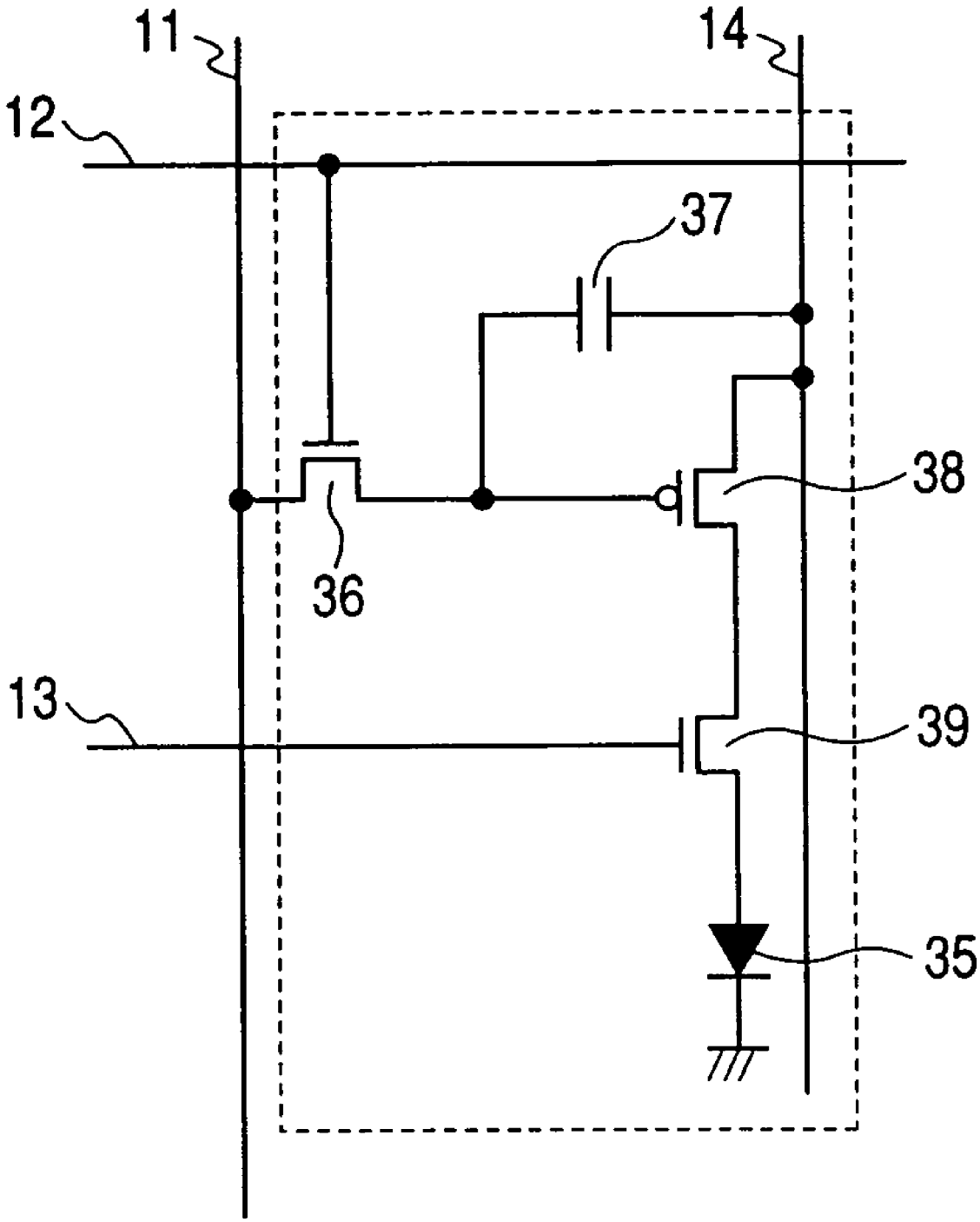
FIG. 10 is a circuit diagram for describing a first construction example suitable for a pixel circuit in the embodiments of FIGS. 1, 3, and 4.

The following describes a pixel configuration provided in a display area of the display device of the present invention. The same reference numerals as those in the previous embodiments in each drawing correspond to same functional portions. FIG. 10 is a circuit diagram for describing a first construction example suitable for a pixel circuit in the embodiments of FIGS. 1, 3, and 4. In FIG. 10, a portion enclosed by the dotted line indicates one pixel. One pixel includes a select switch 36 connected to a signal line 11 and a select switch 12, a holding capacitor 37 to hold a display signal, an OLED driving switch 38 that drives an organic EL element (OLED element) 35 according to the magnitude of the display signal held in the holding capacitor 37, and an illumination switch 39 that supplies an illumination current from a power line 14 to the OLED element 35 through the OLED driving switch 38 in illumination timing of the OLED element 35.

Figure 11:
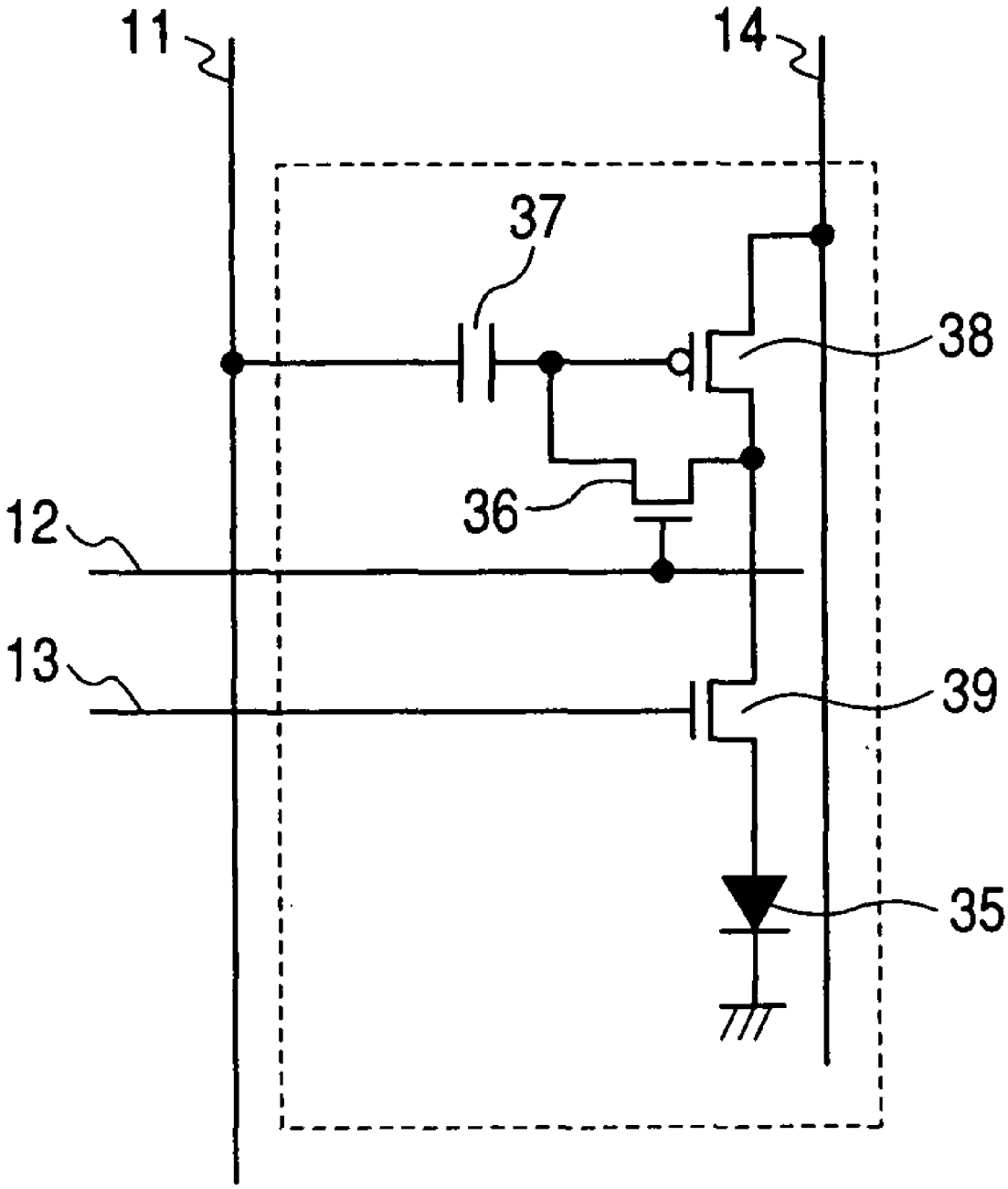
FIG. 11 is a circuit diagram for describing a second construction example suitable for a pixel circuit in the embodiments of FIGS. 1, 3, and 4.

FIG. 11 is a circuit diagram for describing a second construction example suitable for a pixel circuit in the embodiments of FIGS. 1, 3, and 4. In FIG. 11, a portion enclosed by the dotted line indicates one pixel. The pixel circuit of FIG. 11 is constructionally almost the same as that of FIG. 10, except that the disposition of the select switch 36 and the holding capacitor 37 is different from that of FIG. 10.

Figure 12:
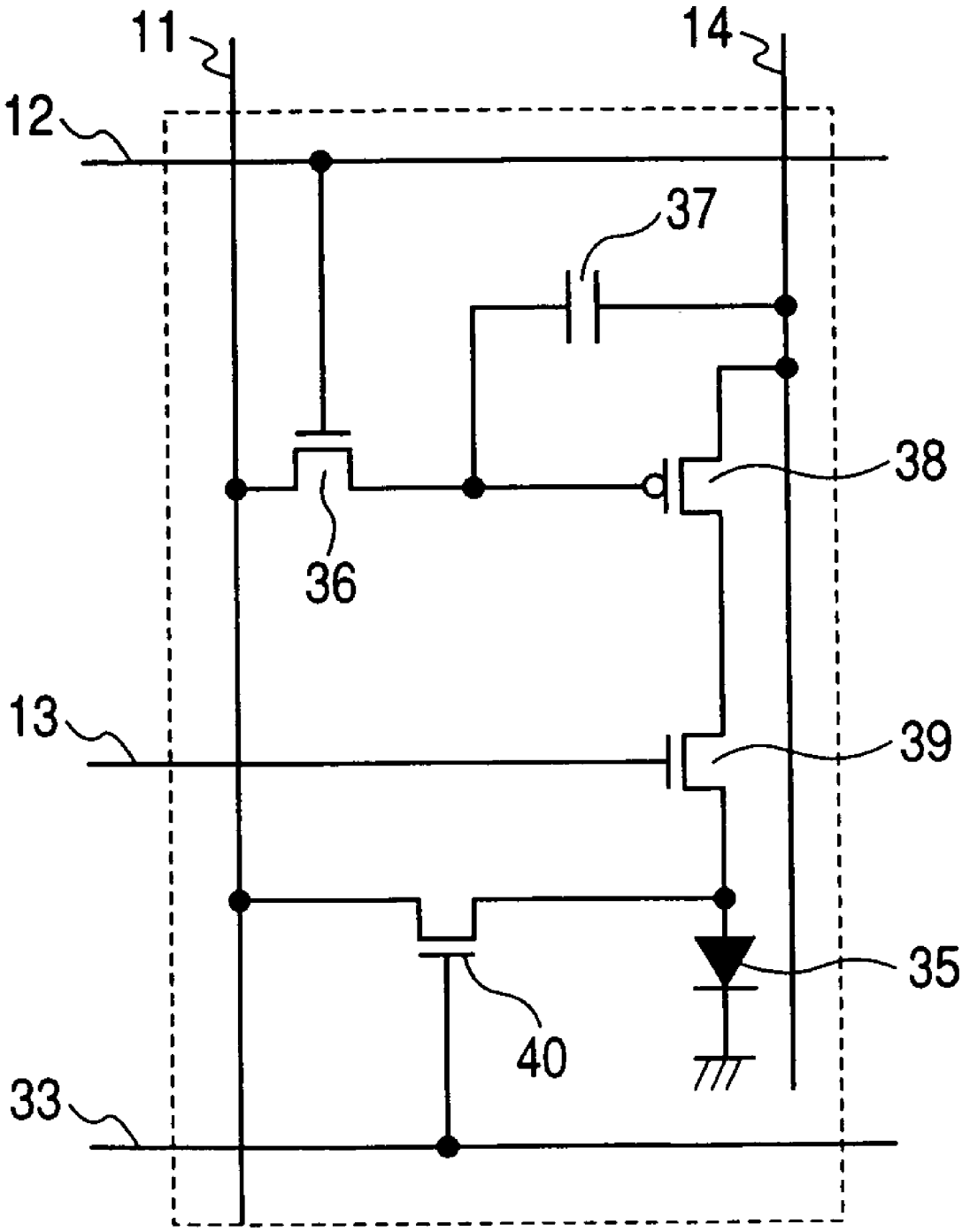
FIG. 12 is a circuit diagram for describing a third construction example suitable for a pixel circuit in the embodiments of FIGS. 5, 6, 8, and 9.

FIG. 12 is a circuit diagram for describing a third construction example suitable for a pixel circuit in the embodiments of FIGS. 5, 6, 8, and 9. In FIG. 12, a portion enclosed by the dotted line indicates one pixel. The pixel circuit of FIG. 11 is an addition of a detection line 33 and a detection switch 40 connected to the detection line 33 to the circuit of FIG. 10.

Figure 13:
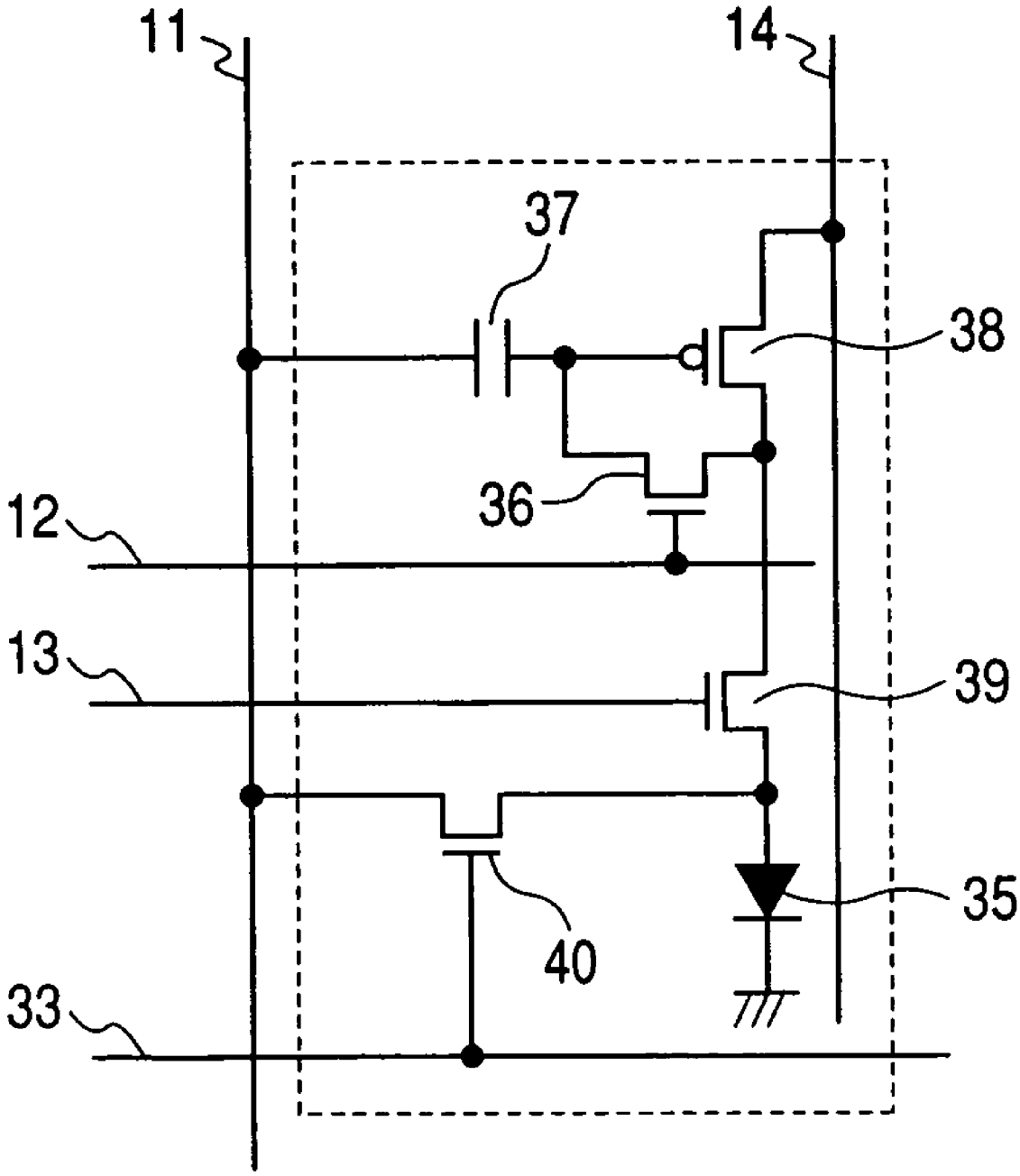
FIG. 13 is a circuit diagram for describing a fourth construction example suitable for a pixel circuit in the embodiments of FIGS. 5, 6, 8, and 9.

FIG. 13 is a circuit diagram for describing a fourth construction example suitable for a pixel circuit in the embodiments of FIGS. 5, 6, 8, and 9. In FIG. 13, a portion enclosed by the dotted line indicates one pixel. The pixel circuit of FIG. 13 is an addition of the detection line 33 and the detection switch 40 connected to the detection line 33 to the circuit of FIG. 11.

Figure 14B:
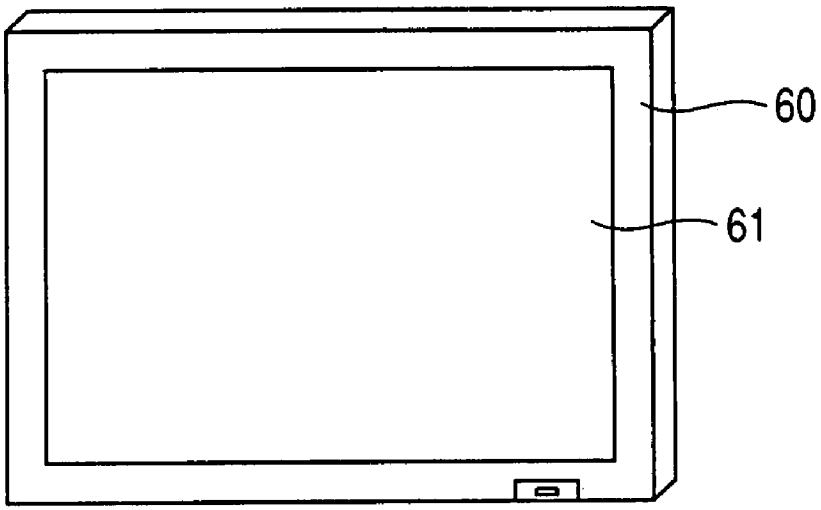
FIG. 14A and FIG. 14B are drawings showing an example of electronic equipment equipped with a display device of the present invention.
Figure 14A:
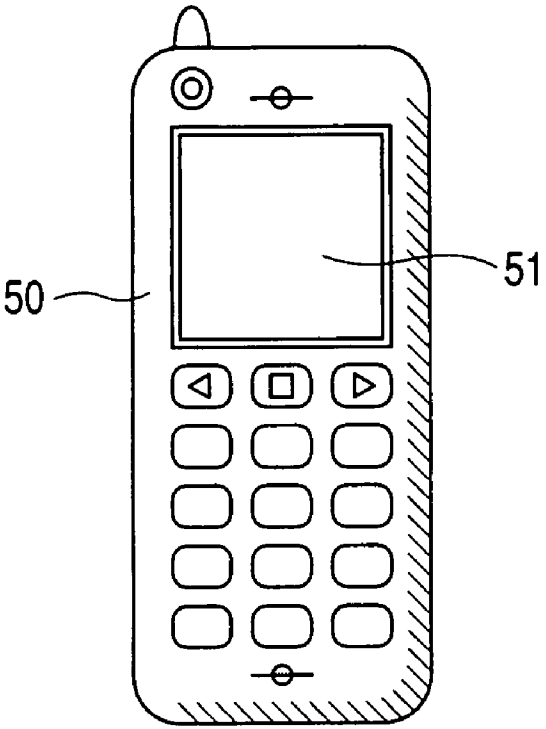

FIGS. 14 and 15 are drawings showing an example of electronic equipment equipped with the display device of the present invention. FIG. 14A shows a mobile electronic equipment 50, a so-called cellular phone, and its display part 51 is equipped with the display device of the present invention. FIG. 14B shows a television receiver 60, and its display part 61 is equipped with the display device of the present invention.

Figure 15B:
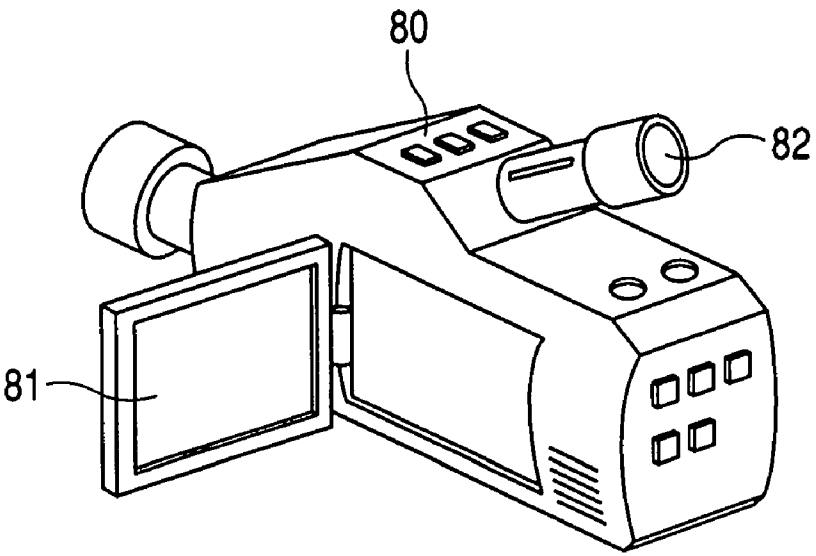
FIG. 15A and FIG. 15B are drawings showing an example of electronic equipment equipped with a display device of the present invention.
Figure 15A:
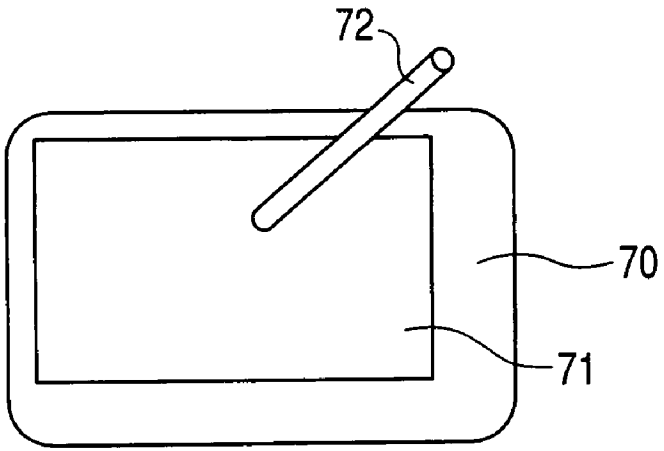
Figure 16:
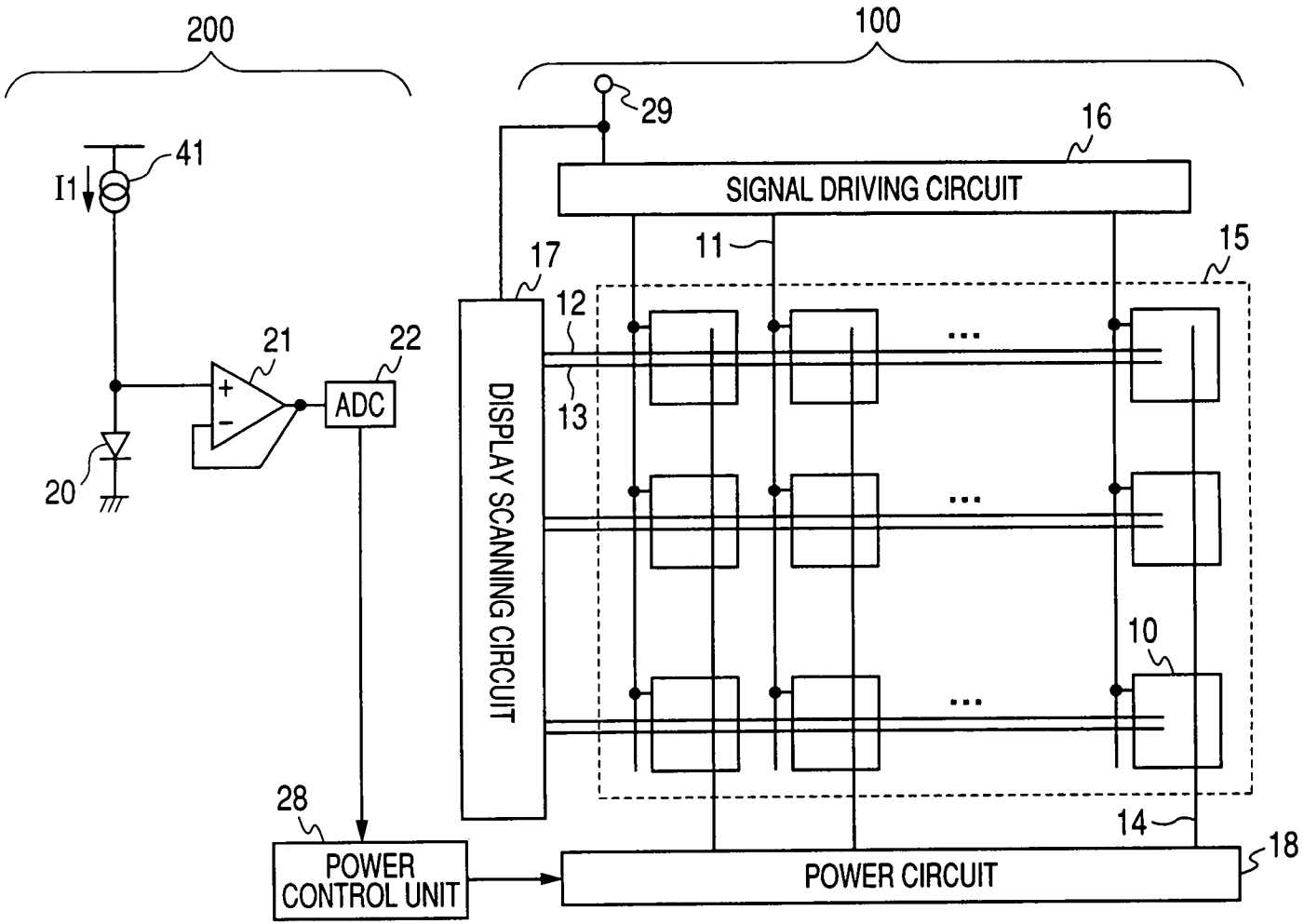
FIG. 16 is a circuit diagram showing a first construction example of an organic EL display panel that constitutes a display device equipped with a traditional temperature correction system.
Figure 17:
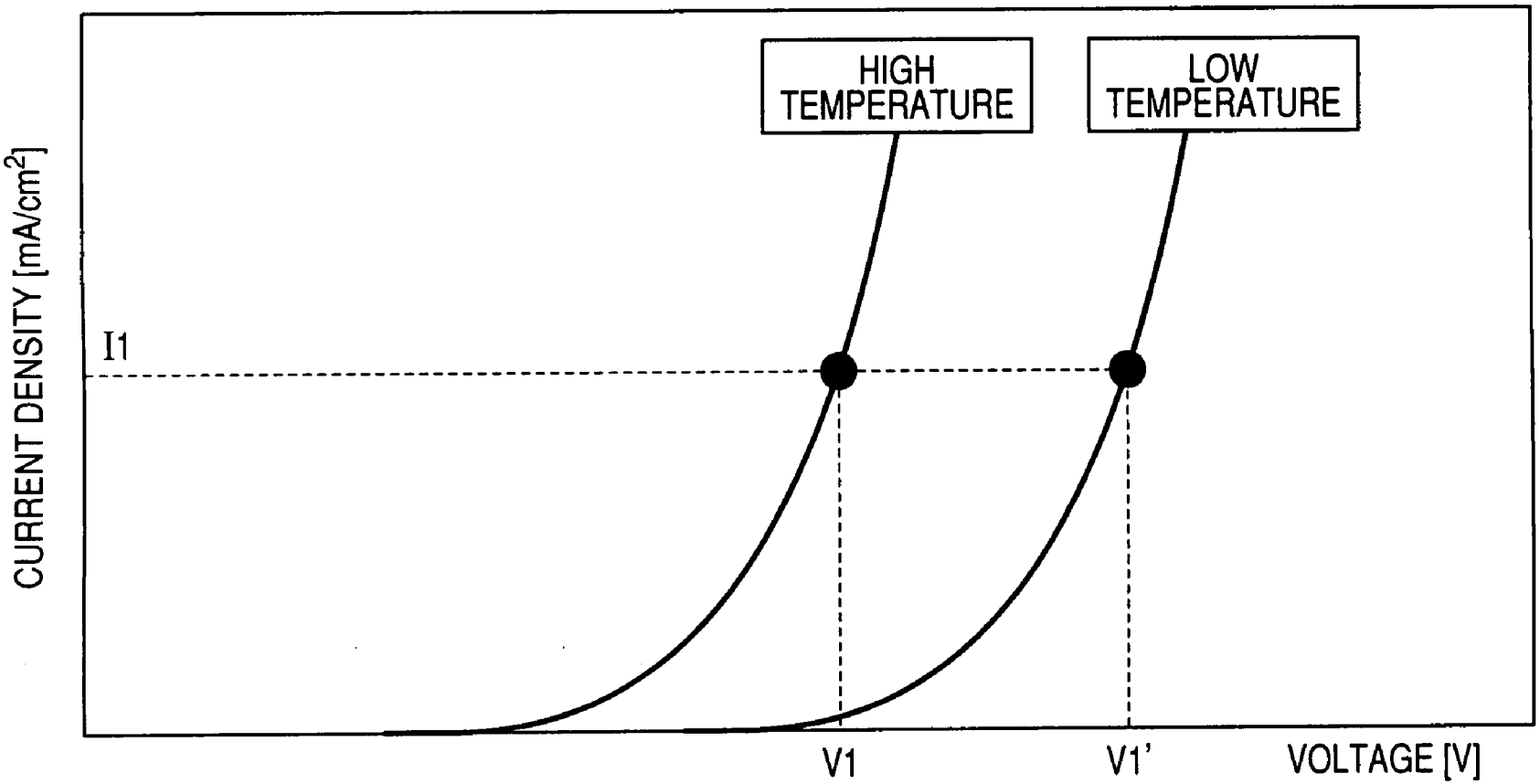
FIG. 17 is an explanatory drawing of detection operation points of a transitional organic EL display panel shown in FIG. 16.
Figure 18:
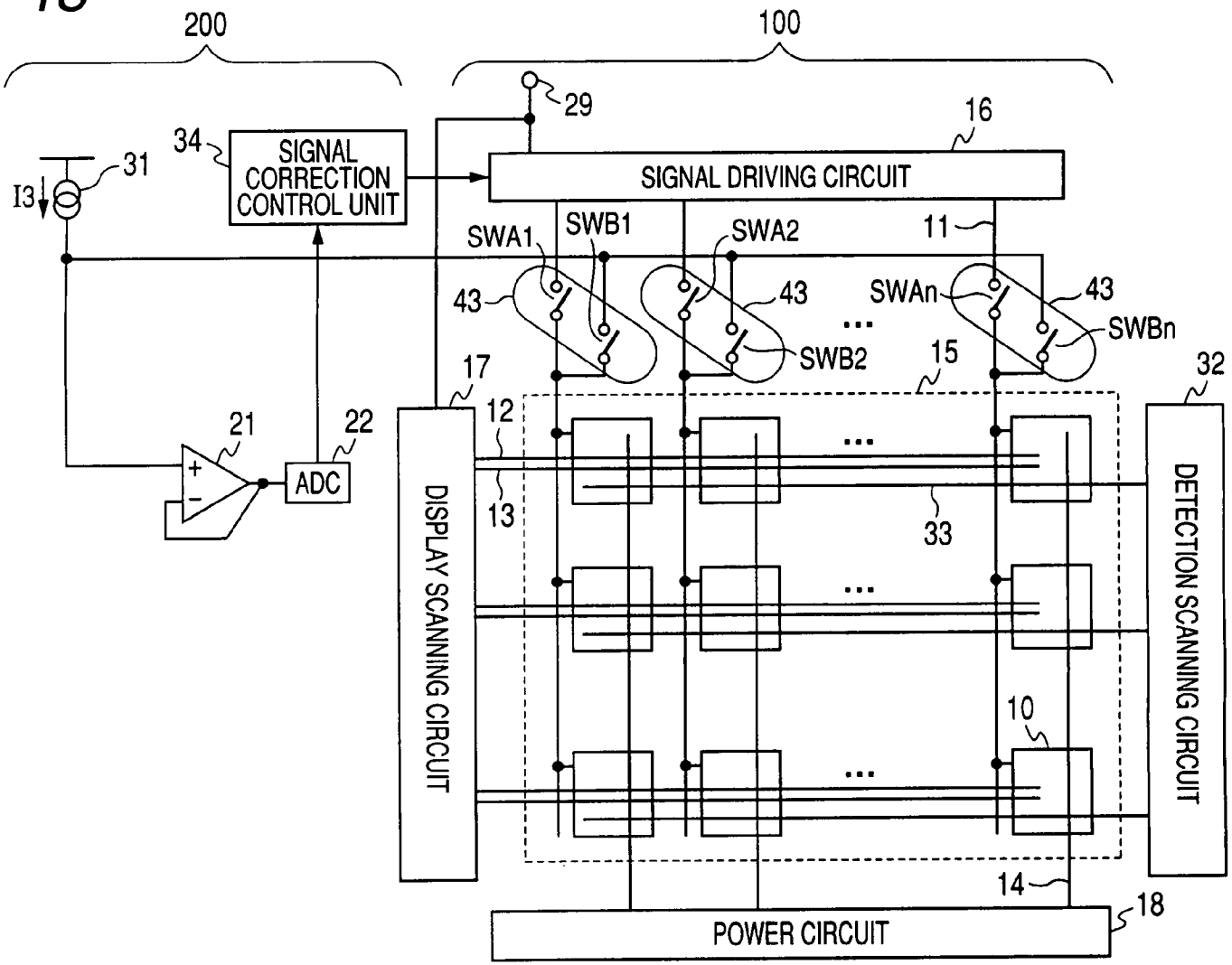
FIG. 18 is a circuit diagram showing a second construction example of an organic EL display panel that constitutes a display device equipped with a traditional temperature correction system.
Figure 19:
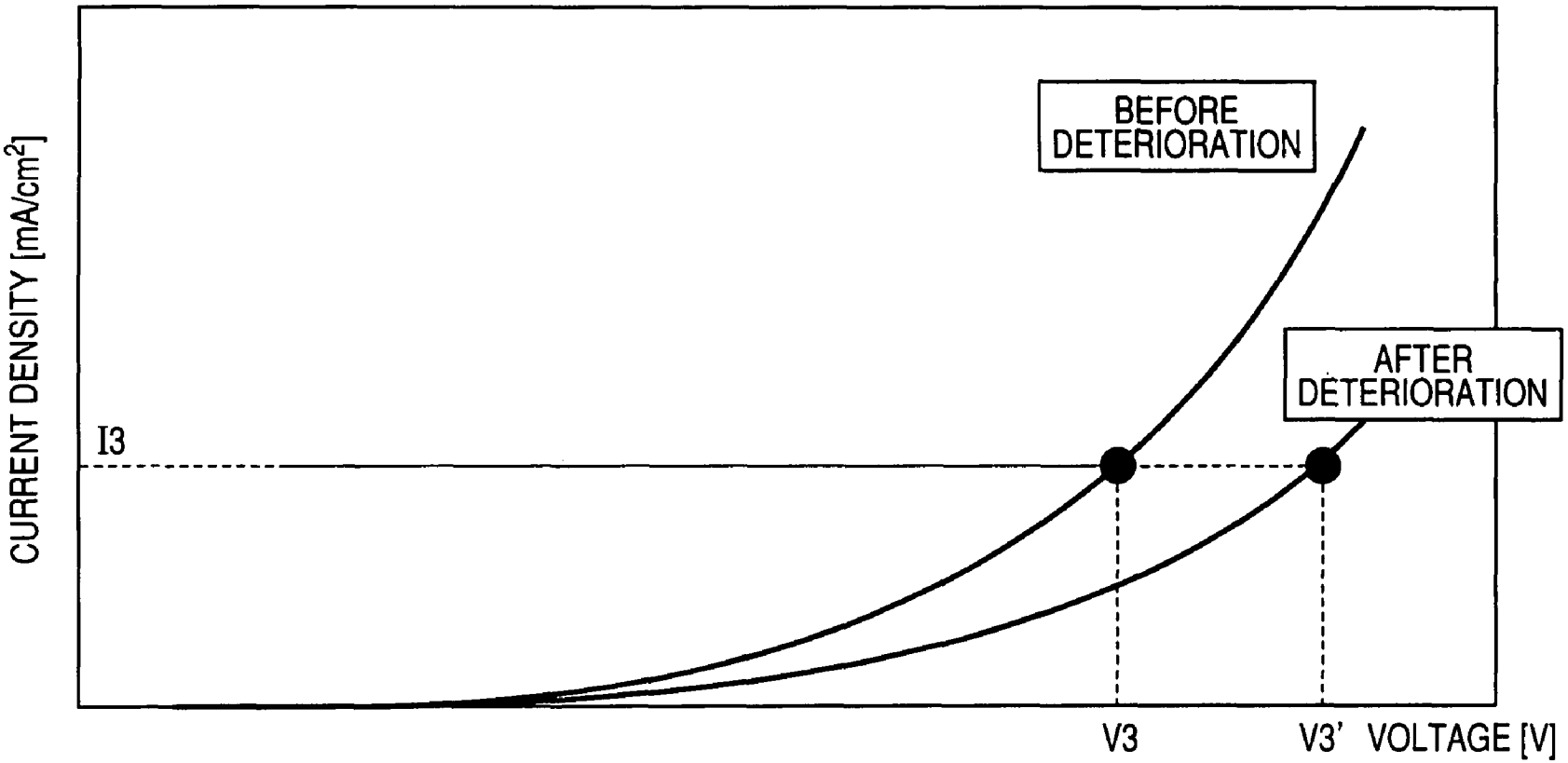
FIG. 19 is an explanatory drawing of detection operation of the transitional organic EL display panel shown in FIG. 18.

FIG. 15A shows a digital portable terminal 70, a so-called PDA, and its display part 71 is equipped with the display device of the present invention. A touch panel is mounted in the display part 71. A reference numeral 72 indicates a stick for screen input. FIG. 15B shows a video camera 80, and its monitor part 81 and finder part 82 each are equipped with the display device of the present invention. It goes without saying that the display device of the present invention can find various applications as described above.

What is claimed is:

1. A display device comprising:

a display part including:

a display area that includes pixels formed in the vicinity of intersections of plural signal lines intersecting with plural select switch lines;

a display scanning circuit that applies a select signal to the select switch lines;

a signal driving circuit that supplies a display signal to the signal lines;

a power line that supplies a current for illuminating each of the plural pixels with brightness corresponding to the display signal from the signal driving circuit; and a power circuit that supplies a current to the power line; and a detection unit that includes:

a monitor element of constant current driving that detects environmental temperatures; and a current source that outputs plural constant current values;

an A/D converter unit that detects a voltage value by a detection operation of the monitor element;

a decoder unit that generates a current source control signal to change a constant current value supplied to the monitor element according to an output from the output from the A/D converter;

a power control unit that generates a power control signal to control an output voltage of the power circuit according to an output of the A/D converter; and a detection unit changeover means that changes over a constant current value of the current source corresponding to variations in environmental temperatures.

2. The display device according to claim 1, wherein the monitor element is an organic EL element, and the current source that outputs the plural constant current values includes a high-voltage side current source and a low-voltage side current source that are different in current value, and wherein the detection unit changeover means, which are inserted between each output of the high-voltage side current source and the low-voltage side current source and the organic EL element, include a changeover switch that alternatively selects output of one of the high-voltage side current source and the low-voltage side current source, and the organic EL element.

3. The display device according to claim 1, wherein the monitor element is an organic EL element, and the current source that outputs the plural constant current values is configured with a constant current source of band gap type including a first and a second external resistance elements having different resistance values, and wherein the detection unit changeover means, which are respectively inserted between the first and the second external resistance elements and the constant current source of band gap type, include a changeover switch that alternatively selects outputs of the constant current source of band gap type for output to the organic EL element.

4. The display device according to claim 2, comprising:

a detection control line that is provided in parallel with the select switch lines to detect current values of the pixels;

a detection scanning circuit that applies a scanning signal to the detection control line; and a changeover switch that alternatively selects the signal line driving circuit and the current source for the signal line, wherein, in a display mode, the changeover switch connects the signal line driving circuit to the signal line, and wherein, in a detection mode, the changeover switch connects the current source to the signal line, and a power control unit changes a voltage of the power circuit according to a detection result of the detection unit.

5. A display device comprising:

a display part including:

a display area that includes pixels formed in the vicinity of intersections of plural signal lines intersecting with plural select switch lines;

a display scanning circuit that applies a select signal to the select switch lines;

a signal driving circuit that supplies a display signal to the signal lines;

a power line that supplies a current for illuminating each of the plural pixels with brightness corresponding to the display signal from the signal driving circuit; and a power circuit that supplies a current to the power line;

a detection control line that is provided in parallel with the select switch lines to detect current values of the pixels; and a detection scanning circuit that applies a scanning signal to the detection control line; and a detection unit including:

a current source that outputs plural constant current values;

a detection unit changeover means that selects one of the constant current values of the current source corresponding to variations in environmental temperatures; and a signal correction control unit is connected to the signal driving circuit and corrects the display signal to be supplied to the signal line, wherein the display unit includes a display unit changeover means that alternatively selects the signal driving circuit and the detection unit changeover means for the signal line.

6. The display unit according to claim 5, wherein the current source that outputs the plural constant current values includes a high-voltage side current source and a low-voltage side current source that are different in current value, wherein the detection unit changeover means includes a changeover switch that alternatively selects the high-voltage side current source and the low-voltage side current source, and wherein when the display changeover means supplies a current from the high-voltage current source to the signal line and another line for measuring a current value of the signal line, if the current value is equal to or greater than a specific value, the changeover switch of the detection unit switching means is switched to the low-voltage side current source.

7. The display unit according to claim 5, wherein the current sources that output the plural constant current values are configured with current sources of band gap type that include first and second external resistance elements having different resistance values, and wherein the detection unit changeover means are configured with changeover switches that are respectively inserted between the first and second external resistance elements and the constant current source of band gap type, and alternatively select outputs of the constant current sources of band gap type.

* * * * *